United States Patent [19]

Tsiknopoulos et al.

[11] Patent Number: 4,623,318

[45] Date of Patent: Nov. 18, 1986

[54] FIGURE WITH ROTATABLE TORSO AND VERTICALLY SWINGING ARMS

[75] Inventors: Phedon J. Tsiknopoulos, Los Angeles; Roger H. Sweet, Long Beach, both of Calif.

[73] Assignee: Mattel, Inc., Hawthorne, Calif.

[21] Appl. No.: 682,022

[22] Filed: Dec. 14, 1984

[51] Int. Cl.[4] ..... A63H 3/20

[52] U.S. Cl. ..... 446/330; 446/334; 446/359; 446/236; 446/383; 446/219

[58] Field of Search ..... 446/334, 335, 336, 352, 446/354, 359, 236

[56] References Cited

U.S. PATENT DOCUMENTS

| | | | |
|---|---|---|---|
| 1,452,820 | 4/1923 | Whitcomb et al. | 446/334 |
| 1,558,537 | 10/1925 | Drake | 446/334 |
| 2,632,586 | 3/1953 | Barrango . | |
| 2,638,348 | 5/1953 | Arenson et al. | 446/336 |
| 2,649,806 | 8/1953 | Monaghan | 46/173 |
| 3,147,566 | 9/1964 | Ong | 446/359 |
| 3,234,689 | 2/1966 | Ryan . | |
| 3,350,812 | 11/1967 | Lindsay et al. . | |
| 3,357,610 | 12/1967 | Quinby . | |
| 3,611,625 | 10/1971 | Sloop et al. | 46/120 |
| 3,628,282 | 12/1971 | Mardson et al. . | |
| 3,648,405 | 3/1972 | Tepper et al. | 46/120 |
| 3,988,855 | 11/1976 | Crabtree et al. . | |
| 4,003,158 | 1/1977 | Wolf et al. | 446/334 |
| 4,186,518 | 2/1980 | Luke | 46/148 |
| 4,246,723 | 1/1981 | Winters | 446/359 X |

FOREIGN PATENT DOCUMENTS

| | | | |
|---|---|---|---|
| 837672 | 5/1952 | Fed. Rep. of Germany | 446/334 |
| 940964 | 3/1956 | Fed. Rep. of Germany | 446/334 |
| 642714 | 9/1950 | United Kingdom | 446/352 |

*Primary Examiner*—F. Barry Shay

*Attorney, Agent, or Firm*—Ronald M. Goldman; Melvin A. Klein; Daniel F. Sullivan

[57] ABSTRACT

An animated figure toy (10) includes an upper torso (14) provided with a pair of arms (22) articulately mounted for relative movement thereto upward toward the plane of the shoulders by centrifugal force, as the upper torso is rotated relative to a lower torso (16) upon which it is mounted, by means of a thumbwheel (64) coacting with a drive means (44) connected between the torsos. The individual arms are also rotatable for 360° about an axis through the shoulders.

1 Claim, 4 Drawing Figures

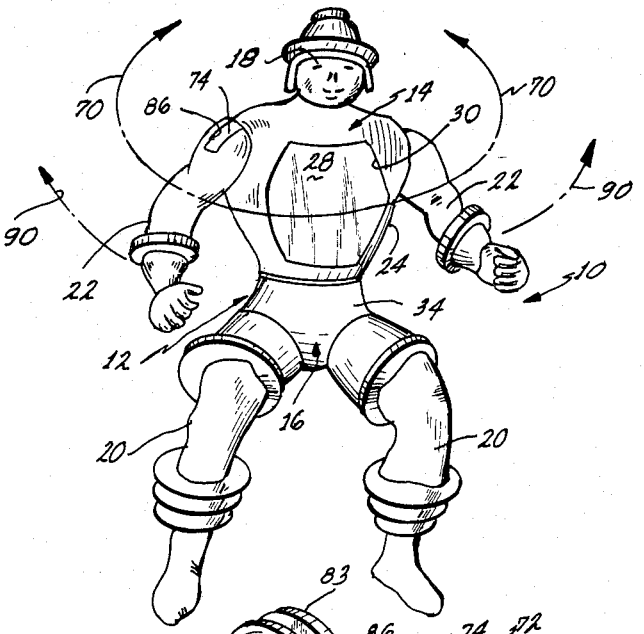
FIG. 1
FIG. 2
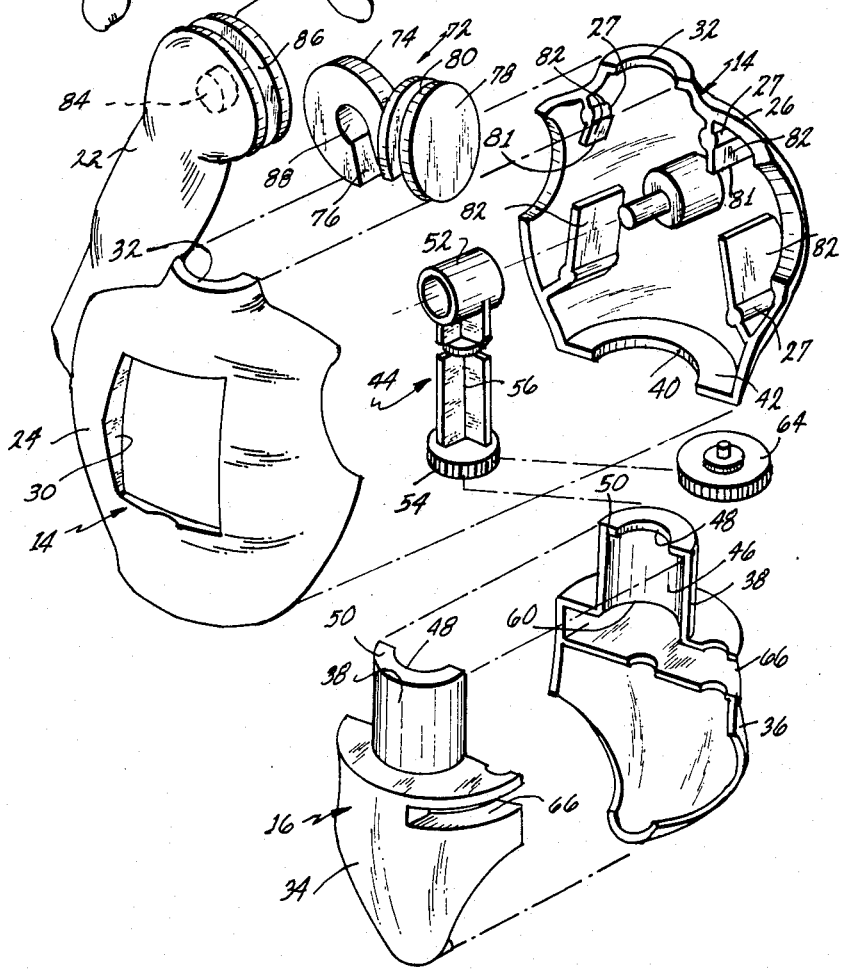

FIGURE WITH ROTATABLE TORSO AND VERTICALLY SWINGING ARMS

TECHNICAL FIELD

The present invention relates to animated figure toys, and more particularly to a new and useful animated figure toy having a moveable or rotatable torso.

BACKGROUND ART

U.S. Pat. No. 2,649,806, discloses doll joints, including in FIG. 6, a slotted hinge joint for use in facilitating insertion of the disc portion of a hinge joint into a slotted ball-type hinge structure.

U.S. Pat. No. 3,611,625, assigned to the assignee of the present invention, discloses an animated doll having an electrical motor contained internally thereof. The motor causes motion of the dolls legs, rotation of the torso of the doll, and delayed rotation of the doll's head.

U.S. Pat. No. 4,186,518, discloses a kicking doll with a detachable trigger means. A toothed rack and a gear are mounted in the torso of the doll with the gear connected to one leg of the doll, whereby when the gear is rotated by the rack through actuation of the trigger means, the leg will kick or pivot outwardly to kick a simulated soccer ball.

None of the above identified patents disclose the figure toy of the present invention having specific means for rotating the upper torso, and to move limbs thereof during rotation.

DISCLOSURE OF THE INVENTION

In accordance with the present invention, a new and useful animated figure toy is provided with a rotatable upper torso. The figure toy includes separate upper and lower torsos and means rotatably connected between the torsos to operate gearing means whereby the upper torso of the figure toy is rotated relative to the lower torso.

The figure toy includes a lenticular lens in the chest of the upper torso to provide an electronic-like effect when the upper torso is rotated.

Furthermore, the figure toy includes at least one arm coupled to the upper torso in such a manner that the rotational movement of the upper torso will cause the arm to rise upwardly, by centrifigal force, no matter what position the arm is in relative to the upper torso.

BRIEF DESCRIPTION OF THE DRAWINGS

Details of the present invention will be described in connection with the accompanying drawings wherein:

FIG. 1 is a perspective view of an animated figure toy consisting of a presently preferred embodiment;

FIG. 2 is an enlarged partial exploded view of the upper and lower torsos of FIG. 1, showing the construction of the torsos and the internal gearing means located therein;

BEST MODE FOR CARRYING OUT THE INVENTION

Figure 4:
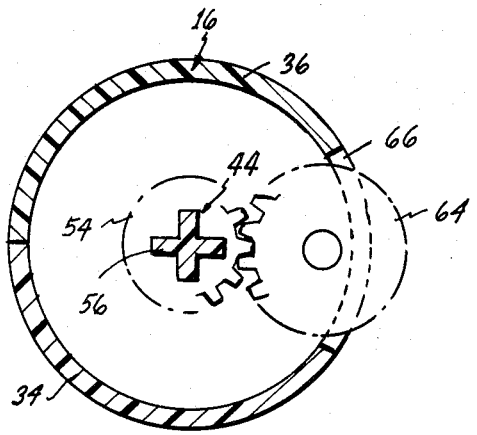
FIG. 4 is a cross-sectional view taken along line 4—4 of FIG. 3.

Referring now to the drawings, a figure toy constituting a presently preferred embodiment of the invention, is generally designated 10. The figure toy includes a body 12 comprising an upper torso 14 and a lower torso 16 which may be rotated 360 degrees with respect to each other. A head assembly 18 is fixed to the upper torso 16, and legs 20 are coupled to the lower torso in any desired manner. In addition, as shown in FIGS. 2 and 4, at least one limb or arm 22 is articulatly mounted in or coupled to a shoulder portion of the upper torso 14, as explained more fully hereinafter.

As shown in FIG. 2 the upper torso 14 is preferably formed from two halves or portions 24, 26 fixed together in any convenient manner, such as by pin and socket type connectors 27. The front half or portion 24 of the upper torso incudes a lens or window 28, such as a lenticular lens. The lens 28 is fixedly mounted within an opening 30 formed in the front portion 24 of the upper torso. Therefore, when the upper torso 14 is moved, the lens 28 will be viewed from different directions or angles, and may be made to give the affect or appearance of a radar screen or other CRT screen.

The two halves 24, 26 of the upper torso 14 are provided with top or neck openings 32 in which the head 18 is captured or wherein it may be journaled, in any convenient manner, for rotatable movement with respect to the upper torso.

Lower torso 16 is also preferably formed from two halves or portions 34, 36, fixed together in the same or a similar manner as upper torso 14. In addition, lower torso 16 may have limbs, such as legs 20 held therein, in any convenient manner. Lower torso 16 is rotatably connected to upper torso 14, by means of a torso connector 38, preferably fixed to or formed integrally with the lower torso. Torso connector 38 extends up into the upper torso 14 through an opening 40 formed within a base 42 of the upper torso 14, for rotational movement therein. Torso connector 38 includes a central shaft means 44, rotatably carried within a hollow interior 46. The central shaft means or portion 44 extends upwardly and out through an opening 48 formed in the top surface 50 of the torso connector 38. It also being understood that the torso connector and operating means, as described below, could be reversed so as to be in the upper torso and extend into the lower torso, if so desired.

The central shaft means 44 includes an upper end connecting means 52, shown as a hollow bearing, and a lower end gear means 54, spaced apart by a central ribbed shank 56.

Figure 3:
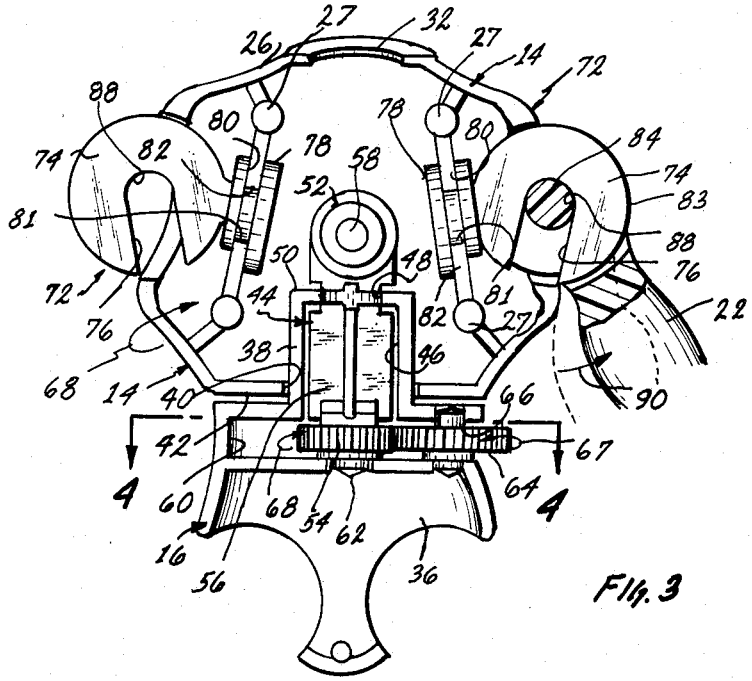
FIG. 3 is an enlarged partial sectional view, looking toward the rear of the figure toy and showing the internal gearing, the arm connections with part of one arm and the direction of movement of the upper torso with respect to the lower torso upon operation of the gearing means.

In the assembled position, as shown in FIG. 3, the upper connecting means 52 is coupled to or held on a holding means 58, such as a pin held in or formed integrally with one of the upper torso halves 24, 26, such as rear half 26. At the same time, the lower end or gear 54 is rotatably captured within an enlarged chamber or opening 60 formed by wall means extending between the two halves 34, 36 of lower torso 16. A support bearing means 62 may be held within the lower torso to aid in rotation of the central shaft portion 44.

A drive means 64, such as a serrated or toothed spur gear is rotatably held within lower torso 16 in aligned relationship with and coupled to gear 54. The spur gear is rotated in the manner of a thumbwheel, and extends outwardly or exteriorly of the lower torso, through a slotted opening 66, formed therein (see FIGS. 2–4). In this manner, the thumbwheel or drive means 64 may be stroked or turned in any desired manner, as by the thumb of a user, in either direction. Due to the number of gear teeth or serrations on drive means 64 coacting with the smaller internal or driven gear 54, having fewer teeth, the driven gear 54 will be rotated at a higher rate of speed than drive means 64.

As shown by arrow 67 in FIG. 3, if thumbwheel 64 is rotated in the clockwise direction, gear 54, and through central shaft means 44, the upper torso 14, will be rotated in the counterclockwise direction, as indicated by arrow 68. Conversely, if thumbwheel 64 is rotated in the counterclockwise direction, the direction opposite that shown by arrow 67, upper torso 14 will be rotated in the clockwise direction, the direction opposite that shown by arrow 68. This capability of rotation of the upper torso 14 in either direction is illustrated in FIG. 1, by broken arrow 70, having two heads.

To further increase the play value of the figure toy of this invention, the upper torso 14 is provided with articulating arms 22. These arms may be manually articulated or moved in any desired direction by means of arms connectors or joints 72, rotatably mounted within shoulder portions of the upper torso. The arms 22 and joints 72 are rotatably mounted in the upper torso, as by means of circular disc like members 74 fixed to or formed integrally with a wheel or pulley like holding portion 78. A slotted opening 76 is formed in disc member 74, while an internal slot 80 is formed in pulley-like member 78. The slot 80 is captured within an opening or space 81 formed between wall members 82 fixed in or formed integrally within the two halves 24, 26 of the upper torso 14. The disc like members 74, as well as the arms 22 fixed thereto, may be manually rotated by moving the wheel or pulley like members 78 within the openings 81 formed in the wall members 82 (see FIG. 3), after the two halves of the upper torso are fitted together.

The shoulder or upper ends 83 of the arm or limb members 22 are inserted into and held to the arm connectors by action of the disc like members 74 coacting with pin members 84, held in or formed integrally within the shoulder ends 83 of the arms. The pins 84 are forced into the slots 76 formed in the disc like members 74, by means of the disc like members entering a further slot 86 formed in each shoulder end 83 (FIG.2). That is, the slot 86 of each arm is slipped over the disc like members 74 and the pins 84 are forced into the slots 76. The pins 84 are pushed upwardly into an enlarged opening 88 formed at the end of each slot. The disk like members 74 and shoulder ends 83 may be moved or rotated with respect to each other in any convenient manner during fabrication (assembly) in order to fit the pins 84 into the enlarged openings 88. The disc like members are preferably made from a resilient material, such as a resilient plastic, to enable the slots 76 to be expanded, pushed or biased apart as the pins 84, preferably slightly larger than the slots, are forced upwardly in the slots. The pins 84 are designed so as to fit easily into the enlarged openings 88, and are easily rotatable therein. That is, after the slots 76 return to their rest or unstressed positions, as shown in FIG. 3, the shoulder ends 83 of the arms 22 will be rotatably captured within the arm connectors 72, while at the same time the arm connectors 72 will be rotatably captured within the shoulder portions of the upper torso.

With the arms rotatably held in place, as shown in FIGS. 1 and 3, the upper torso may be rotated via the spur gear or thumbwheel 64, as previously described. Upon actuation or rotation of the upper torso, in the direction of the arrow 70, with sufficient speed, the arms 22 will rise upwardly, around the pins 84, in the direction of arrows 90, rotating about axes generally perpendicular to the axes of rotation of the pulley like members 78 (see FIGS. 1–3). This upward movement is, of course, caused by the centrifigal force generated when the upper torso is rotated with sufficient force. Since the arms 22 are also free to rotate 360 degrees about the axes of the pulley-like members 78, each arm 22 is able to move in two predetermined, generally perpendicular planes.

It therefore can be seen that a user of the animated figure toy of the present invention may rotate the upper torso in either direction, and if rotated with sufficient speed, to also cause the arms to move outwardly. In addition, the lenticular lens 28 within the chest cavity will form interesting designs as the upper torso, with its upraised arms, is rotated. It should be noted that the gearing, namely gears 54, 64 is such that a child of tender years may easily rotate the upper torso fast enough for the arms to fly or move out, and stay out, during rotation of the upper torso. When the upper torso rotates with the arms in the raised position, this causes a "Whirling" effect in the upper torso. Thus, when using this animated figure toy with other toys or animated figure toys, the "Whirling" of the upper torso and raised arms may be used to strike or knock down other toys or figures.

While the particular animated figure toy herein shown and described in detail is fully capable of attaining the objects and providing the advantages herein before stated, it is to be understood that it is merely illustrative of the presently preferred embodiment of the invention, and that no limitations are intended by the details of construction or design herein shown and described, other than as defined in the appended claims.

The term "means", as employed in the claims is to be interpreted as defining the corresponding structure illustrated and described in the specification or the equivalent thereof.

We claim:

1. A figure toy comprising:

a lower torso;

an upper torso rotatably coupled to said lower torso, said upper torso having at least one shoulder portion and at least one wall member attached thereto;

shaft means for rotatably coupling said upper and lower torsos together, said shaft means having a first end coupled to said upper torso and a second end rotatably mounted in said lower torso;

first and second gears, operably meshing together, said first gear being rotatably mounted in said lower torso with a portion of said first gear extending outside said lower torso and said second gear being coupled to said shaft means so that rotation of said first gear in one direction causes said second gear, said shaft means and said upper torso to rotate in an opposite direction;

at least one arm, each of said arms being operably coupled to one of said shoulder portions; and means for coupling each of said arms to its said one shoulder portion so that each arm is adapted for (a) rotating 360 degrees in a first predetermined plane around a first axis with respect to its said one shoulder portion and (b) rotating in a second predetermined plane around a second axis in an outward direction from said upper torso due to centrifugal force resulting from rotation of said upper torso, said first predetermined plane being generally perpendicular to said second predetermined plane and said first axis being generally perpendicular to said second axis, said coupling means including a pulley-like member rotatably engaging one of said wall members and a disc-like member attached to said pulley-like member, said disc-like member operably engaging a slot in said arm and rotatably engaging a pin located in said slot.

* * * * *